US007766668B1

(12) United States Patent
Bishop

(10) Patent No.: US 7,766,668 B1
(45) Date of Patent: Aug. 3, 2010

(54) LOW PROFILE ELECTRICAL CONDUCTOR ASSEMBLY FOR INTERCONNECTING CONDUCTIVE COMPONENTS IN A STACKED CONFIGURATION

(75) Inventor: Peter Bishop, Cambridgeshire (GB)

(73) Assignee: AVX Corporation, Myrtle Beach, SC (US)

( * ) Notice: Subject to any disclaimer, the term of this patent is extended or adjusted under 35 U.S.C. 154(b) by 0 days.

(21) Appl. No.: 12/369,364

(22) Filed: Feb. 11, 2009

(51) Int. Cl.
*H01R 12/00* (2006.01)
*H01R 1/00* (2006.01)

(52) U.S. Cl. ..... 439/66

(58) Field of Classification Search ..... 439/66, 439/862, 74, 41, 91, 695
See application file for complete search history.

(56) References Cited

U.S. PATENT DOCUMENTS

| | | | | |
|---|---|---|---|---|
| 5,041,016 | A | 8/1991 | Machado et al. | |
| 6,068,514 | A * | 5/2000 | Zuin | 439/630 |
| 6,077,089 | A | 6/2000 | Bishop et al. | |
| 6,604,950 | B2 * | 8/2003 | Maldonado et al. | 439/66 |
| 6,758,702 | B2 * | 7/2004 | Johnescu | 439/862 |
| 6,759,104 | B2 * | 7/2004 | Hayakawa et al. | 428/1.6 |
| 6,939,172 | B2 * | 9/2005 | Lu | 439/607.2 |
| 7,226,297 | B2 * | 6/2007 | Li | 439/71 |
| 2002/0160632 | A1 | 10/2002 | Maldonado et al. | |
| 2005/0130499 | A1 | 6/2005 | Zheng | |

FOREIGN PATENT DOCUMENTS

| | | |
|---|---|---|
| EP | 0 463 487 | 1/1992 |
| GB | 2 348 320 | 9/2000 |
| WO | WO 97/02631 | 1/1997 |
| WO | WO 2006/081119 | 8/2006 |

OTHER PUBLICATIONS

UK Patent Office Search Report, Apr. 22, 2010.

* cited by examiner

*Primary Examiner*—Chandrika Prasad
(74) *Attorney, Agent, or Firm*—Dority & Manning, P.A.

(57) ABSTRACT

A thin profile electrical connector assembly for interconnecting conductive components, such as circuit boards, in a stacked configuration, includes a frame-shaped insulating body member having opposite ends and opposite leg members. A plurality of adjacently disposed and spaced apart connector elements are configured on at least one of the leg members. Each connector element includes a lower arm held in the leg member and that terminates at a contact tail that extends outward from an outer side of the leg member, and a resilient arm that extends from the lower arm at an obtuse angle towards the opposite leg member. The resilient arm terminates in a resilient contact nose that extends above an upper surface of the leg members. The insulating body defines an open space between the opposite leg members whereby the resilient arms of the connector elements are pressed into the open space upon use of the connector assembly such that the connector assembly has a profile height in use that corresponds essentially to the thickness of the leg members.

14 Claims, 6 Drawing Sheets

Fig. 1A
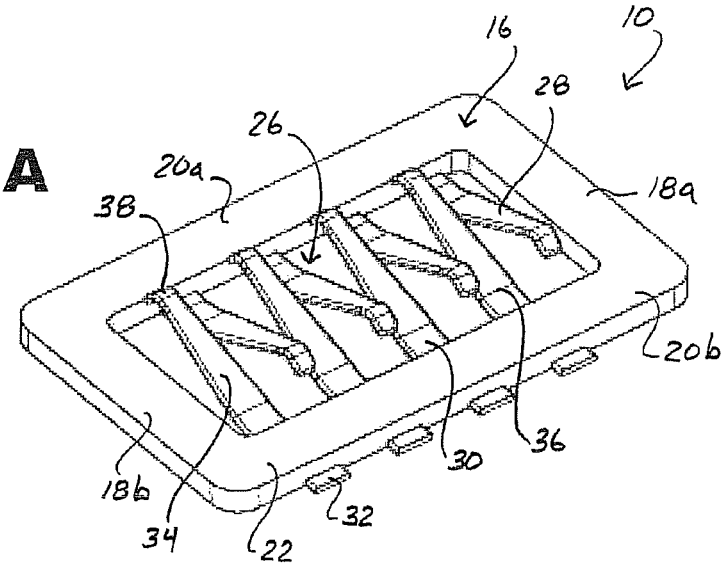
Fig. 1B
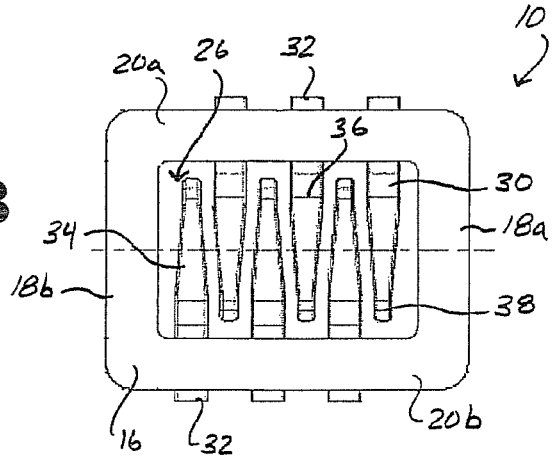
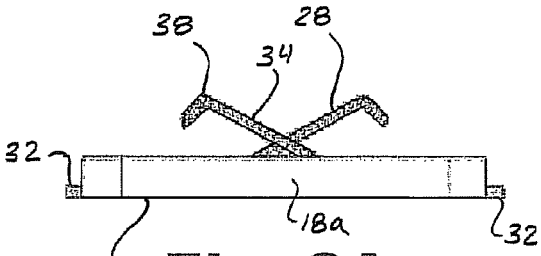
Fig. 2A
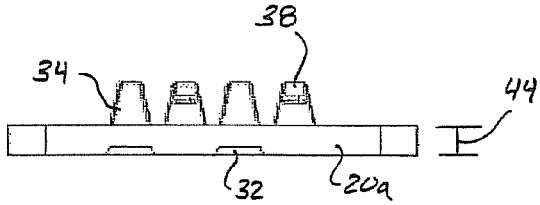
Fig. 2B

LOW PROFILE ELECTRICAL CONDUCTOR ASSEMBLY FOR INTERCONNECTING CONDUCTIVE COMPONENTS IN A STACKED CONFIGURATION

BACKGROUND OF THE INVENTION

The present invention relates to electrical connectors in general, and more particularly to electrical connectors used to interconnect electronic subassemblies, for example printed circuit boards, which are required to be mounted adjacent to each other often in a vertically stacked configuration.

Prior art methods are known for interconnecting electronic assemblies, particularly circuit boards. For example, it is well known to hard wire the boards together, or to use edge connectors carried by the boards that engage with complimentary fixed edge connectors carried within a frame in which the boards are mounted.

A concern with conventional board-to-board connectors is the limited space for connection of the boards or assemblies within the electronic device. With conventional connectors utilizing a plurality of terminals laterally arranged at intervals in a housing, one contact leg of each terminal is soldered to the circuit pattern of one printed board and the other leg of the contact is soldered to the circuit pattern on the other printed board. As a result of the narrow intervals between the terminals and vertical distance between the boards, it is extremely difficult to solder each of the terminals without bridging an adjacent terminal with solder. The soldering procedure is a time consuming and difficult task.

One suggested improvement is disclosed in the European patent specification Publication No. 0 463 487 published on Jan. 2, 1992. Therein, an electrical connector is described having a terminal housing with a plurality of terminals laterally arranged and fixed at regular intervals with two leg contacts of each terminal extending from the housing. A connector casing loosely accommodates the terminal housing and permits the terminal housing to slide up and down within the casing. The casing in turn has extensions for fixing it to one printed board and means to permit the printed board to come into contact with the other terminals. This device, however, requires an adequate space between the circuit boards to accommodate the connector casing and terminal housing. The minimum distance or height between adjacent circuit boards is thus unnecessarily limited, particularly in a stacked configuration of circuit boards.

The published PCT Application No. WO 97/02631 discloses an electrical connector for connecting adjacent circuit boards, including stacked circuit boards. The connector includes a generally I-shaped insulating body defining a plurality of adjacent recesses into which identical contact elements are mounted. The contact elements have at least one resilient contact arm that resiliently bends or moves within the body recess.

U.S. Pat. No. 6,077,089 discloses a thin, low profile electrical connector wherein a plurality of adjacently disposed and spaced apart connector elements are mounted on a longitudinally extending leg of a body member. Each connector element includes a closed end and an open end defined by extending arms, with the closed end wrapping around the longitudinal leg of the body member.

U.S. Pat. No. 5,041,016 and the European Patent Specification No. 0 346 206 disclose other types of printed circuit board connectors.

OBJECTS AND SUMMARY OF THE INVENTION

It is a principal object of the present invention to provide an improved electrical connector having a low profile that is particularly suited for interconnecting stacked circuit boards or other components.

Still a further object of the present invention is to provide an electrical connector having a relatively minimum height so as to interconnect vertically stacked circuit boards with a minimal separation distance between the boards.

Additional objects and advantages of the invention will be set forth in part in the following description, or may be obvious from the description, or may be learned through practice of the invention.

In accordance with the objects and purposes of the invention, a low or "thin" profile electrical connector assembly is provided for interconnecting physically distinct components, such as circuit boards, in a stacked configuration. The connector assembly includes an insulating body member having opposite ends and opposite leg members. The body member may have, for example, a rectangular or square shape that defines an open space bordered by the ends and leg members in a frame-type structure.

A plurality of adjacently disposed and spaced apart connector elements are configured on at least one of the leg members, and are provided on both leg members in a particularly unique embodiment. Each of the connector elements is a thin, blade-like structure having a lower arm held or retained in the leg member. The lower arm terminates at a contact tail that extends outward from an outer side or edge of the leg member, and may be essentially flush with the bottom surface of the leg member. The connector elements include a resilient arm that extends from the lower arm at an obtuse angle into the open space of the body member, towards the opposite leg member, and above a plane of the upper surface of the body member. The resilient arm terminates in a resilient contact nose that extends above the upper surface of the leg members.

In use of the connector assembly to connect components in a stacked configuration, the contact tails of the lower arms are electrically connected (e.g., by soldering) with contact pads provided on a first component in a pattern that matches the number and spacing of the contact tails. The tails may be soldered onto the contact pads in a conventional soldering process. The contact noses of the connector elements are pressed against corresponding contact pads on a second component, with the resilient arms of the connector elements being pressed into the open space in the body member. In this manner, the connector assembly has a profile height in use that corresponds essentially to the thickness of the leg members.

In a particularly unique embodiment, the connector assembly provides a plurality of connector elements on each of the leg members such that the connector elements on one leg member are staggered between the connector elements on the opposite leg member. The connector elements are spaced apart in their staggered configuration such that the elements fit between adjacent, oppositely oriented elements within the open space of the body member in use of the connector assembly.

The connector elements may be retained in the insulating body member by various means. In one embodiment, the connector elements are molded into the leg members in an over-molding process. Additional retaining structure may be provided to ensure that the connector elements are securely retained. For example, a barb may be formed in the lower arm portion of the elements that projects into the leg member of the body member. A hole, recess, or the like, may also be defined in the lower arm member to allow molten material to flow into and form around the lower arm member in the molding process of the body member. In an alternate embodiment, retaining structure may be molded directly into the leg members at defined connector positions along the leg member to engage and retain the connector elements that are subsequently press-fitted into the retaining structure at the connector positions. For example, the retaining structure may include grooves or recesses that are machined or molded into the leg members. The grooves or recesses may further comprise engaging or positioning surfaces defined therein that are configured to retain and position each connector element at each connector position along the leg member.

The connector assembly may also include alignment structure defined on the body member, for example on the upper or lower surfaces of any combination of the leg members or ends of the body member. The alignment structure can comprise any manner of configuration so as to engage with complimenting structure on the stacked circuit boards or other components to precisely position the connector assembly relative to the component. For example, the alignment structure may comprise one of a male or female member for engagement with a respective female or male member on a circuit board.

So as to provide for alternate stack heights without increasing the overall thickness of the body member, spacing structure may be defined on any combination of the leg members or ends of the body member. This structure may include, for example, flat tab members configured on the upper surface of the opposite ends of the body member to provide an increased vertical stack height between adjacent stacked components. With this embodiment, the contact noses extend above the upper surface of the spacing structure.

A principal concern of the present invention is to provide a connector assembly having a minimal profile or stack height. In this regard, a preferred embodiment of the connector comprises a profile height of less than about 0.5 mm, which corresponds essentially to the thickness of the insulating body member. In a particular embodiment, the profile height of the connector assembly in use is 0.4 mm. The profile height of the connector assembly is not, however, a limitation of the invention.

In order to aid in precise positioning of the connector assembly on a circuit boards, engaging structures, such as male or female members, may be defined on the body member so that a positioning cap or similar device may be used to grasp and precisely locate the connector element on the circuit board. This structure may also serve as positioning or alignment structure that is matable with complimenting structure on the circuit boards.

It should be appreciated that a plurality of connector assemblies according to the invention can be utilized in any number of configurations. For example, a plurality of the connector assemblies could be placed on a single placement cap for placement in any desired pattern on a circuit board.

The present connector assembly is not limited by any particular material of construction and, in this regard, any conventional suitable materials may be utilized in manufacture of the connector assembly components.

The invention will be described in greater detail below through preferred embodiments as illustrated in the attached figures.

BRIEF DESCRIPTION OF THE DRAWINGS

FIG. 1A is a perspective view of one embodiment of an electrical connector assembly according to the invention;

FIG. 1B is a top view of a 6-way connector assembly embodiment according to aspects of the invention;

FIG. 2A is an end side view of an embodiment of a connector assembly;

FIG. 2B is a leg side view of an embodiment of a connector assembly;

DETAILED DESCRIPTION

Figure 3A:
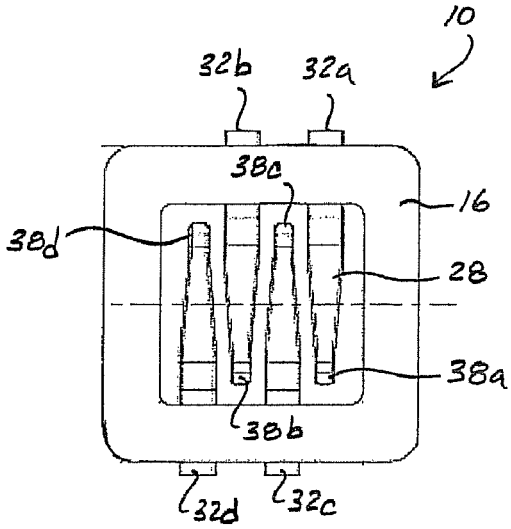
FIG. 3A is a top view of a 4-way connector assembly.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield still a third embodiment. It is intended that the present invention include such modifications and variations as come within the scope and spirit of the present invention.

Exemplary preferred embodiments of a connector assembly, generally 10, according to the invention are illustrated in the figures. Connector assembly 10 is particularly useful in interconnecting component members, such as circuit boards, in a stacked configuration while minimizing the stack height between the components. For ease of explanation and illustration, the mating component members are illustrated and referred to herein as circuit boards. However, this is not a limitation of the invention, and the connector assemblies 10 can be used to interconnect any conventional conductive or component members.

A connector assembly 10 in accordance with aspects of the invention is particularly useful when a minimal stack height (profile height) between opposing circuit boards is desired. In this regard, in preferred embodiments, the connector assembly allows for stack heights of less than about 0.5 mm, and in a desirable embodiment provides a stack height of 0.4 mm. As illustrated for example in FIG. 7, connector assembly 10 provides an efficient and secure device for interconnecting pads 14 of conventional facing circuit boards 12*a*, 12*b*.

Although the invention will be described generally in terms of interconnecting circuit boards, and with reference to structure sufficient for connecting the circuit boards, it should be understood that the boards and connector assemblies 10 according to the invention may further be retained or secured in frame structure of whatever electrical component the elements are contained in. Such configurations are well understood by those skilled in the art and need not be described in great detail herein.

Referring to the various figures, embodiments of a connector assembly 10 are illustrated. The connector assembly 10 in FIG. 1A is an 8-way connector in that it provides eight separate connector elements 28. The connector assembly 10 in FIG. 3A is a 4-way connector in that it provides four separate connector elements 28. Likewise, the connector assembly 10 illustrated in FIG. 1B is a 6-way connector in that it provides six separate connector elements 28.

Each connector assembly 10 includes an insulating body member 16 having opposite ends 18*a*, 18*b* and opposite longitudinally extending leg members 20*a*, 20*b*. As illustrated in the figures, the insulating body member 16 may have a rectangular or square shape that defines an open space 26 bordered by the ends 18*a*, 18*b* and longitudinally extending leg members 20*a*, 20*b*, as in a frame-type structure. It should be readily appreciated, however, that the rectangular or square shape of the insulating body member 16 is not a limiting factor of the invention. The body member 16 may take on any manner of geometric form or shape.

A plurality of adjacently disposed and spaced apart connector elements 28 are configured on at least one of the leg members 20*a*, 20*b* for each connector assembly 10. In the illustrated embodiments, a plurality of the connector elements 28 are disposed along each of the leg members. However, it is within the scope and spirit of the invention that only a single one of the leg members 20*a*, 20*b* includes the connector elements 28 extending towards the opposite leg member.

The insulating body member 16 may be formed of any suitable insulating material commonly used in connector assemblies. For example, this material may be a high temperature plastic material such as STANYL high temperature resistant nylon, or nylon 46 HF 5040.

Figure 3B:
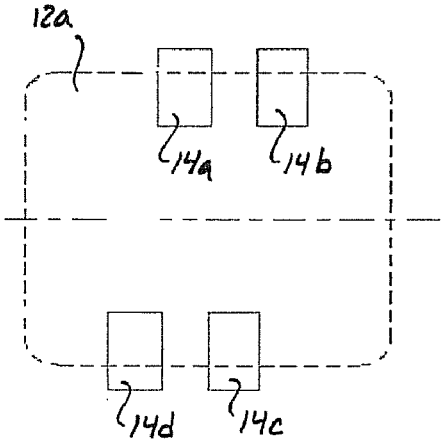
FIG. 3B is a diagrammatic view of an electrical component, such as a circuit board, having a pad footprint for connection with the contact tails of FIG. 3A.
Figure 7:
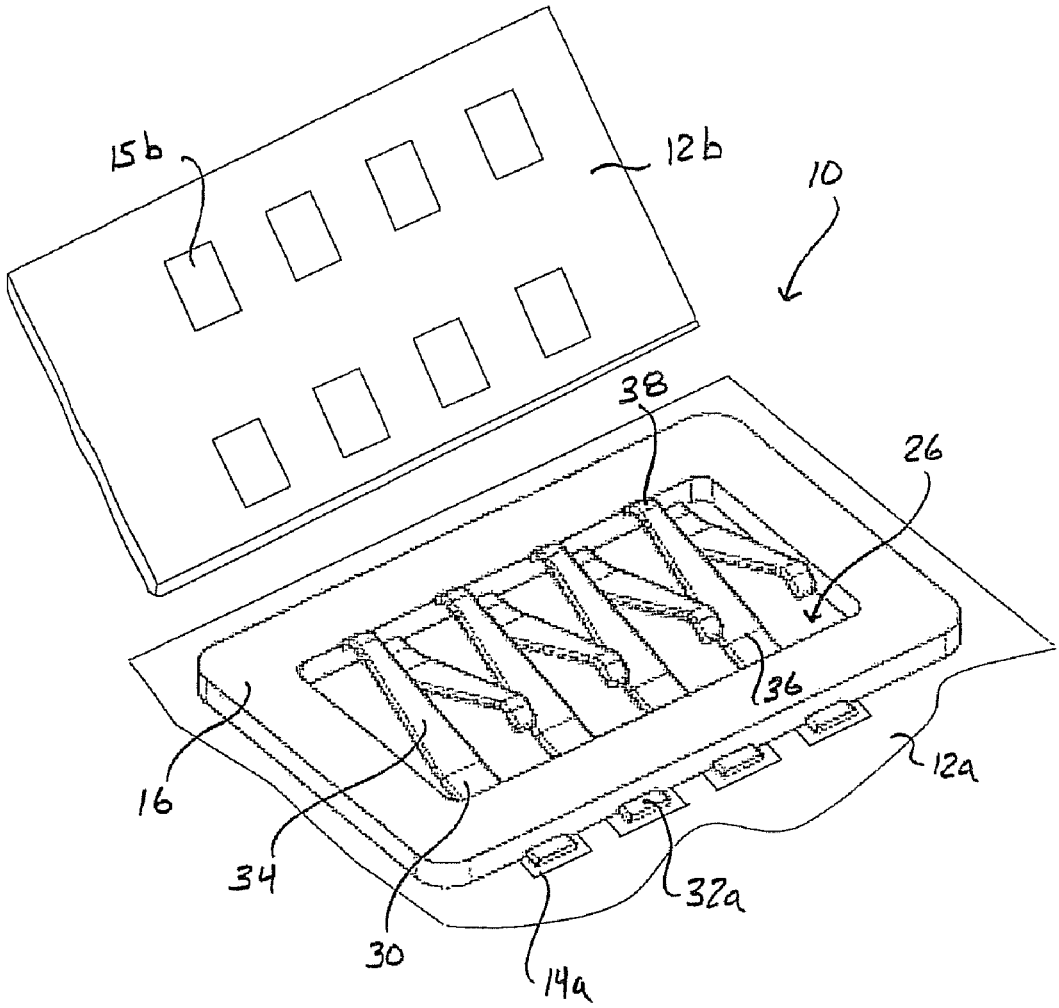
FIG. 7 is a perspective view of a connector assembly in accordance with aspects of the invention as it would be used to electrically connect stacked components; such as circuit boards.

Each of the connector elements 28 is a thin, blade-like structure having a lower arm 30 held or retained in a respective leg member 20*a*, 20*b*, as illustrated in the figures. The lower arms 30 may be essentially straight and flat, and extend partially into the open space 26 in the body member 16 along a plane that is coextensive with the bottom surfaces of the body member 16. The lower arm 30 terminates at a contact tail 32 that extends outward from an outer side or edge of the respective leg member 20*a*, 20*b*, as particularly illustrated in the perspective views of FIGS. 1A, 2A, 4A, 5A, and 6A. These contact tails 32 lie essentially flush in the plane of a lower surface 24 of the insulating body member 16, as particularly illustrated in FIGS. 2A and 2B. In this manner, the contact tails 32 do not add to the stack height 44 (FIG. 2B) of the connector assembly 10. Referring to FIG. 7, the contact tails 32*a* may be soldered or otherwise electrically connected to contact pads 14*a* of a component 12*a*. The contact pads 14*a* are disposed on the component 12*a* in a pattern and footprint that corresponds to the spacing and position of the contact tails 32 on the connector assembly 10. FIG. 3B diagrammatically illustrates a component 12*a*, such as a circuit board, having contact pads 14*a*-14*d* in a pattern and footprint thereon to match the spacing and position of the contact tails 32*a*-32*d* of the connector assembly 10 in FIG. 3A. Connector assembly 10 is placed on the circuit board 12*a* in a conventional pick-and-place process wherein the contact tails 32*a*-32*b* are subsequently soldered to the contact pads 14*a*-14*d*.

The connector elements 28 include an upper resilient arm 34 that extends from the lower arm 30. As illustrated in the various figures, the upper arm 34 is angled upwards at an obtuse angle (greater than 90 degrees and less than 180 degrees) from the lower arm 30. This angular relationship may be defined by a distinct bend 36 (FIG. 1A), or may be a gradual radiused bend. The resilient arm section 34 extends from the lower arm 30 towards the opposite leg member of the insulating body 16 without extending over the opposite leg member, as particularly illustrated in the top views of FIGS. 1B and 3A. Thus, the resilient arms 34 extend upwardly beyond an upper face 22 of the insulating body member 16 and into the open space 26 defined by the body member.

Figure 3C:
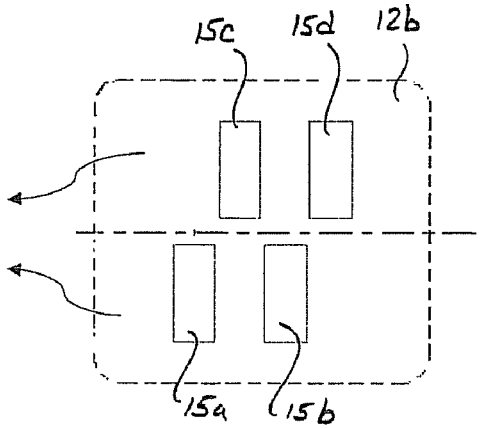
FIG. 3C is a diagrammatic view of a component having an electrical pad footprint for connection with contact noses of the connector assembly of FIG. 3A.

Each of the resilient arms 34 terminates in a contact nose 38. The nose 38 is configured to engage against contact pads on an electrical component in a stacked configuration. For example, FIG. 3C illustrates an electrical component 12*b* having a pattern of contact pads 15*a*-15*d* corresponding to the position of the contact noses 38*a*-38*d* of the connector assembly 10 in FIG. 3A. The contact noses 38 may be defined by a radiused or down-turned terminal portion of the resilient arms 34, as illustrated in the figures.

In use of the various connector assemblies 10 to connect components 12*a*, 12*b* (FIGS. 3B, 3C, 7) in a stacked configuration, the resilient arms 34 of the various connector elements 28 are in pressed mating contact with the corresponding pads 15 on one of the components (i.e., component 12*b*) and have sufficient resiliency so as to be in constant pressing contact against the pads 15 without being soldered when the component 12*b* is retained against the upper surface 22 of the insulating body member 16. As discussed above, the contact tails 34 of the lower arms 30 of the connector elements 28 are soldered or otherwise held in electrical mating contact with the pads 14*a* of the opposite component 12*a*. Thus, in use of the connector assembly 10, the upper component 12*b* is flush against the upper surface 22 of the body member 16, and the lower component 12*a* in the stacked configuration is flush against the lower surface 24 of the body member 16 such that the connector assembly 10 provides a stack height 44 (FIG. 2B) that corresponds essentially to the thickness of the insulating body member 16. In a particularly unique embodiment, the insulating body member 16 has a thickness or height dimension of 0.40 mm, which corresponds to a stack height between the components of 0.40 mm. It should be appreciated that other stack heights are obviously within the scope and spirit of the invention, and that the body member 16 may be formed with any desired thickness or profile height.

It should be readily appreciated that the individual connector elements 28 may be formed from any suitable conductive material commonly used for electrical contacts or connectors. For example, the connector elements 28 may be formed from 0.1 mm thick nickel plated beryllium copper. The contact noses 38 may include gold, and the contact tails 32 may include tin. The invention is not limited by the configuration or materials used to make the connector elements 28.

In the illustrated embodiments, the unique connector assemblies 10 provide a plurality of the connector elements 28 on each of the leg members 20*a*, 20*b* so that the connector elements 28 on one leg member 20*a* are staggered between the oppositely oriented connector elements 28 on the opposite leg member 20*b*. The connector elements 28 are spaced apart in this staggered configuration such that the elements fit between adjacent oppositely oriented elements and nest between adjacent elements within the open space 26 of the body member 16 in connected use of the assembly 10.

Figure 4A:
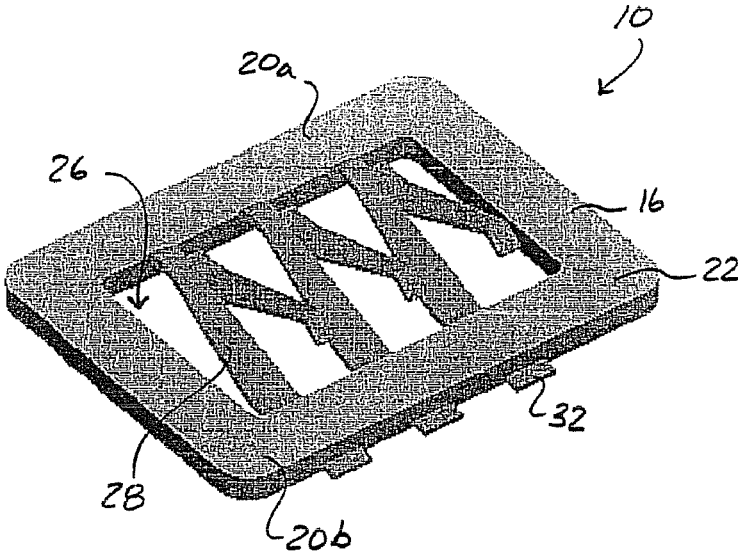
FIG. 4A is a perspective view of a 6-way connector assembly in accordance with an embodiment of the invention.
Figure 4B:
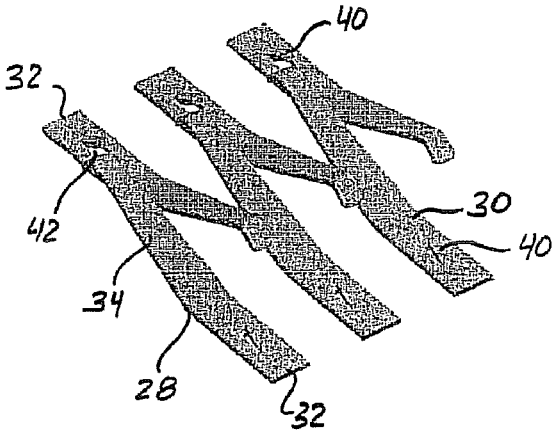
FIG. 4B is a perspective view of the connector elements used in the embodiment of FIG. 4A.
Figure 4C:
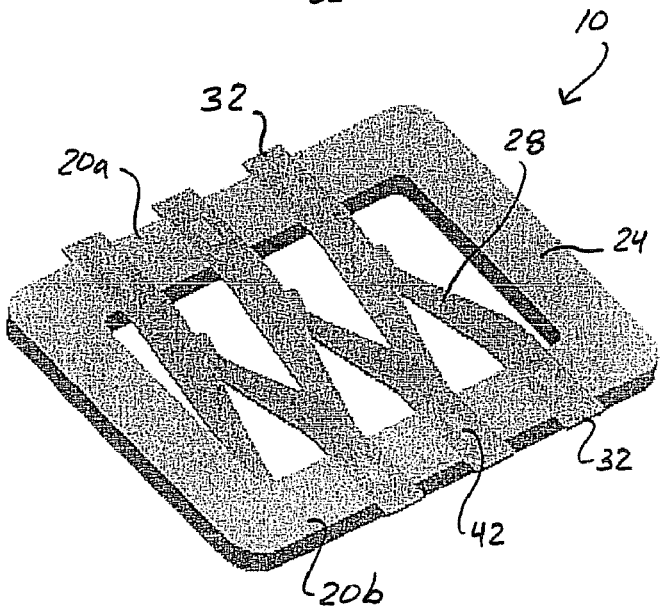
FIG. 4C is an underside view of the connector assembly according to FIG. 4A.

The connector elements 28 may be retained in the leg members 20*a*, 20*b* by various suitable means. In the illustrated embodiment, for example, the connector elements 28 are molded into the leg members in an over-molding process wherein the polymer composition used to form the body member 16 is molded at least partially around and over the lower arms 30 of the connector elements. Referring to FIGS. 4B and 4C, additional retaining structure may be provided to ensure that the connector elements 28 remain securely fastened to the lower surface 24 of the body member 16. For example, barbs 40 may be defined in the lower arm sections 30 that project into the material of the body member 16. In formation of the barbs 40, holes 42 (FIG. 4D) may also be defined in the lower arms 30. Referring to FIG. 4C, the molten material of the body members 16 flows into these holes 40 during the molding process, thus serving to further secure the connector elements 28 within the body member.

In alternate embodiments, other types of retaining structure may be molded directly into the leg members 20*a*, 20*b* at defined connector positions along the leg members to engage and retain the connector elements 28 that are subsequently press-fitted into the retaining structure at the respective connector positions. For example, the retaining structure may be grooves, recesses, and the like that are machined or molded into the leg members, and that define a position for press-fitting of the connector elements into the leg members. The grooves or recesses may further include engaging or positioning surfaces defined therein that are uniquely configured to retain and position each connector element 28 at a connector position along the leg member.

Referring to the various views of FIGS. 5A-5C and 6A-6D, the connector assemblies 10 may also include any manner of alignment structure defined on various surfaces of the body member 16. The alignment structure serves to precisely position the connector assembly 10 relative to stacked components 12*a*, 12*b*. For example, in the illustrated embodiment, the alignment structure is defined by a male protrusion 48 that may be provided on one or more of the upper 22 or lower 24 surfaces of the body member 16. These protrusions 48 have a size and shape so as to engage in respective female structures defined in the components 12*a*, 12*b*. Alternatively, the alignment structure may be defined in the body members 16 as female structure, such as holes or recesses, having a shape and configuration to be engaged by male structures on the components 12*a*, 12*b*. It should be appreciated by those skilled in the art that any manner of engaging structure can be utilized in this regard.

Figure 5A:
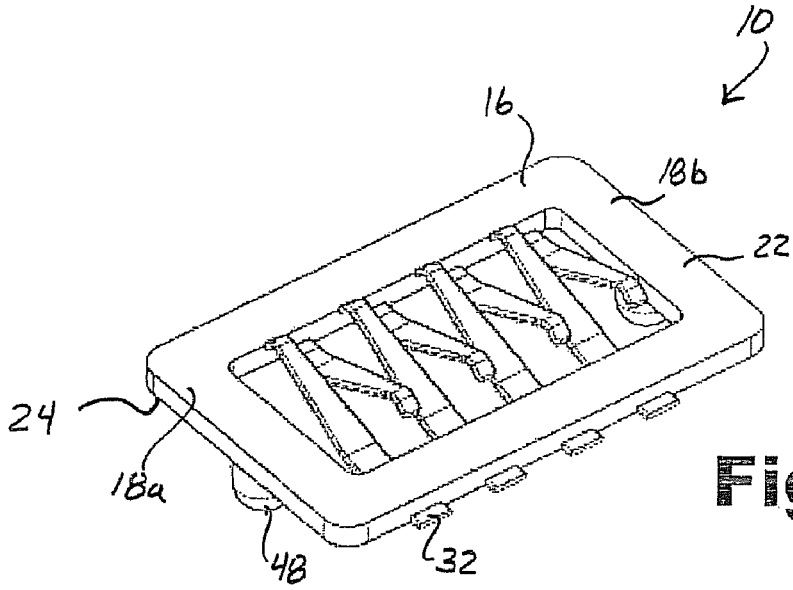
FIG. 5A is a perspective view of an 8-way connector assembly in accordance with an embodiment of the invention.
Figure 5B:
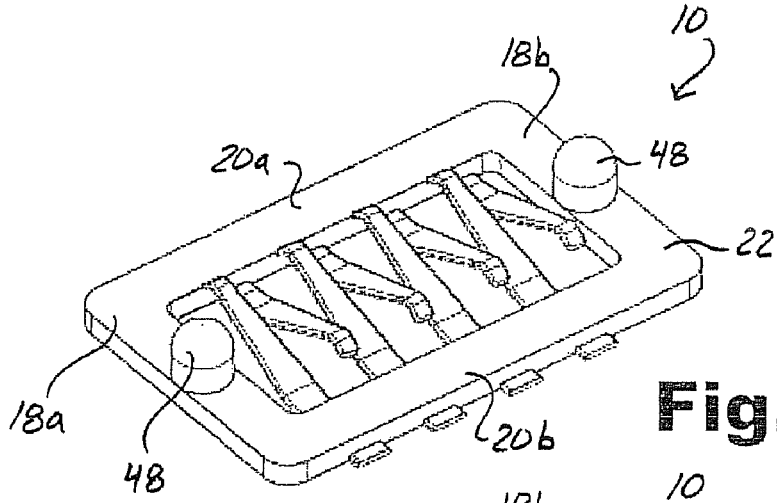
FIG. 5B is an embodiment of a connector assembly in accordance with aspects with the invention incorporating alignment structure on the upper surface of the insulating body.
Figure 5C:
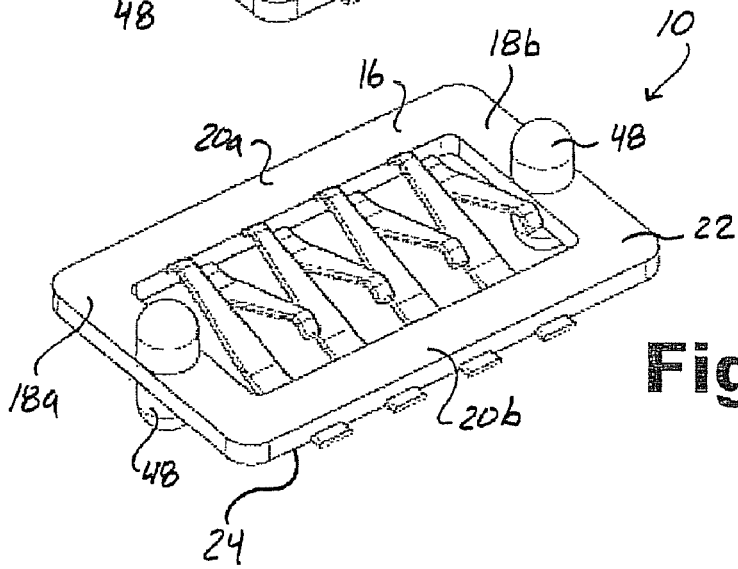
FIG. 5C is an embodiment of an electrical connector assembly incorporating alignment structure on the upper and lower surfaces of the insulating body member.

In the embodiment of FIG. 5A, the alignment structure is defined by protrusions 48*a* provided on the bottom surface 24 of the body member 16, for example on the bottom surface 24 of the ends 18*a*, 18*b* of the body member. In the embodiment of FIG. 5B, the protrusions 48 are defined on the upper surface 22 of the ends 18*a*, 18*b*. In the embodiment of FIG. 5C, the protrusions 48 are provided on the upper 22 and lower surfaces 24 of the ends 18*a*, 18*b*.

It may also be desired to provide various types of spacing structure 50 on any one of the surfaces of the body member 16. The spacing structure 50 effectively increases the profile or stack height of the connector assembly 10 without increasing the entire thickness or profile height of the remaining portions of the body member 16. For example, in the embodiment of FIG. 6A, the spacing structure 50 is defined by tab members 52 having a relatively flat upper surface. These tab members 52 are provided on the upper surface 22 of the end sections 18*a*, 18*b*, and the upper surface of the tabs 52 provide a seating surface for a stacked component. In this embodiment, the stack component would rest on the tabs 52 and a space would be defined between the upper surface 22 of the remaining portions of the body member 16 and the stack component. Thus, the contact noses 38 of the respective connector elements 28 would be angled to such an extent so as to extend above the upper surface of the tabs 52 to ensure positive electrical contact with mating pads on the stacked component.

Figure 6A:
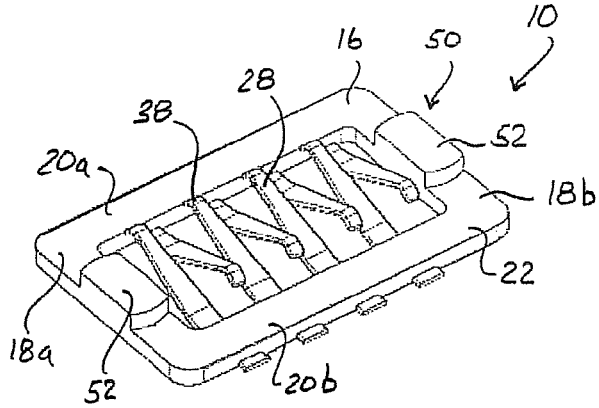
FIG. 6A is a perspective view of an 8-way connector assembly in accordance with an embodiment of the invention incorporating spacing structure on an upper surface of the insulating body member.
Figure 6B:
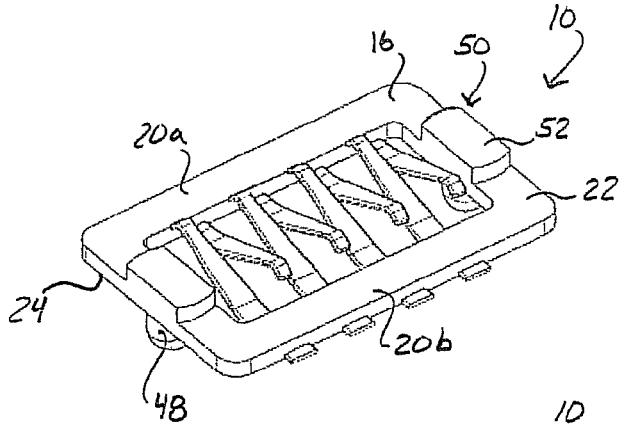
FIG. 6B is a perspective view of an embodiment according to FIG. 6A incorporating alignment structure on the underside of the insulating body member.
Figure 6C:
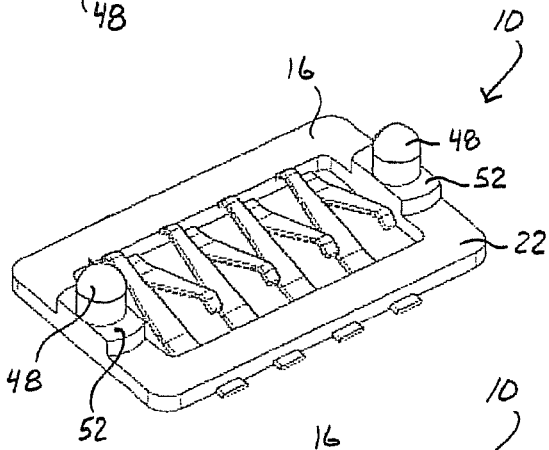
FIG. 6C is a perspective view of an 8-way connector assembly incorporating a combination of spacing structure and alignment structure on the upper surface of the insulating body member.
Figure 6D:
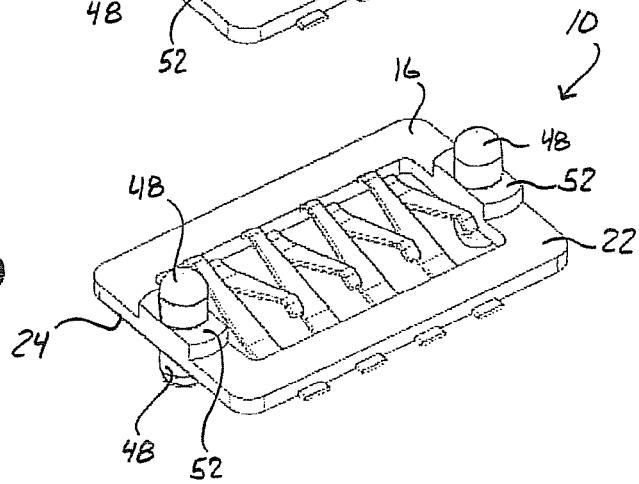
FIG. 6D is a perspective view of an 8-way connector assembly of FIG. 6C that also incorporates alignment structure on the underside of the insulating body member.

The spacing structure 50 may be provided in addition to the alignment protrusions 48. For example, in the embodiment illustrated in FIG. 6B, the alignment protrusions 48 are provided on the lower surface 24 of the body member 16, and the spacing structure tabs 52 are provided on the upper surface 22 of the body member 16. In the embodiment of FIG. 6C, the protrusions 48 are provided on the spacing structure tabs 52. The embodiment of FIG. 6D is similar to that of FIG. 6C and includes alignment structure protrusions 48 on the under surface 24 of the body member 16.

Although not illustrated in the figures, it should be readily appreciated that any manner of additional structure may be releasably attached to the various connector assemblies 10 in order to aid in placement of the assemblies 10 in the manufacturing process. For example, any manner of cap device may be attached to the alignment structures 48 or spacing structures 50. Typical cap devices provide a suitable surface area for a suction nozzle of a pick-and-place device to precisely position the connector assemblies 10 relative to circuit boards or other components. Alternatively, any manner of additional structure may be provided on the body members 16 for releasable engagement of cap devices for this purpose.

It should be appreciated by those skilled in the art that various modifications and variations can be made in the present invention without departing from the scope and spirit of the invention. For example, features illustrated as part of one embodiment can be used on another embodiment to yield still further embodiments. Such modifications and variations are within the scope and spirit of the invention and appended claims.

What is claimed is:

1. A thin profile electrical connector assembly for interconnecting conductive members, including circuit boards, in a stacked configuration, comprising:

a frame-shaped insulating body member having opposite ends and opposite leg members;

a plurality of adjacently disposed and spaced apart connector elements configured on at least one of said leg members;

each of said connector elements comprising a lower arm held in said leg member and terminating at a contact tail that extends outward from an outer side of said leg member beyond an outermost edge of the leg member and is essentially flush with a bottom surface of said leg member, and a resilient arm that extends from said lower arm, the resilient arm and the lower arm forming an obtuse angle where the resilient arm extends from the lower arm, wherein the resilient arm extends towards said opposite leg member, said resilient arm terminating in a resilient contact nose that extends above an upper surface of said leg members; and said insulating body defining an open space between said opposite leg members whereby said resilient arms of said connector elements are pressed into said open space upon use of said connector assembly such that said connector assembly has a profile height in use that corresponds essentially to a thickness of said leg members.

2. The connector assembly as in claim 1, wherein said lower arm of said connector elements is straight and rigid, and said contact tail lies essentially flush with a bottom surface of said leg members.

3. The connector assembly as in claim 1, wherein a plurality of said connector elements are configured on each of said leg members such that said connector elements on one said leg member are staggered between the connector elements on the opposite said leg member.

4. The connector assembly as in claim 1, wherein said connector elements are molded into said insulating body member at connector positions along said leg member.

5. The connector assembly as in claim 4, further comprising retainer structure between said connector elements and said leg member.

6. The connector assembly as in claim 1, wherein said profile height is less than 0.5 mm.

7. The connector assembly as in claim 6, wherein said profile height is 0.4 mm.

8. The connector assembly as in claim 1, further comprising alignment structure defined on said insulating body, said alignment structure having a configuration so as to engage with complimenting structure on a mating component to precisely position said connector assembly relative to the mating component.

9. The connector assembly as in claim 8, wherein said alignment structure comprises a male member for engagement with a respective female member on the mating component.

10. The connector assembly as in claim 1, further comprising spacing structure defined on said insulating body, said spacing structure extending from said upper surface of said leg members to provide an increased vertical stack height for said connector assembly.

11. The connector assembly as in claim 10, further comprising alignment structure defined on said spacing structure, said alignment structure having a configuration so as to engage with complimenting structure on a mating component to precisely position said connector assembly relative to the mating component at the increased vertical stack height.

12. The connector assembly as in claim 1, wherein said body member further comprises engaging structures defined thereon so that said connector assembly can be removably attached to a positioning cap for placement on a conductive member.

13. The connector assembly as in claim 12, wherein said engaging structures also serve as positioning and alignment structures that engage with complimenting structure on a mating component to precisely position said connector assembly relative to the mating component.

14. A thin profile electrical connector assembly for interconnecting conductive members, including circuit boards, in a stacked configuration, comprising:

a frame-shaped insulating body member having opposite ends and opposite leg members, said insulating body member defining an open space bordered by said opposite ends and said leg members;

a plurality of adjacently disposed and spaced apart connector elements configured on each of said leg members;

each of said connector elements comprising a straight, rigid, lower arm held in said leg member and terminating at a contact tail that extends outward from an outer side of said leg member beyond an outermost edge of the leg member and is essentially flush with a bottom surface of said leg members, and a resilient arm that extends from said respective lower arm, the resilient arm and the lower arm forming an obtuse angle where the resilient arm extends from the lower arm, wherein the resilient arm extends towards said opposite leg member, said resilient arm terminating in a resilient contact nose that extends above an upper surface of said leg members;

wherein said plurality of said connector elements are configured on each of said leg members such that said connector elements on one said leg member are staggered between the connector elements on the opposite said leg member; and whereby said resilient arms of said connector elements are pressed into said open space upon use of said connector assembly such that said connector assembly has a profile height in use that is less than 0.5 mm.

* * * * *